US010049809B2

(12) United States Patent
Kitamura

(10) Patent No.: US 10,049,809 B2
(45) Date of Patent: Aug. 14, 2018

(54) SURFACE-MOUNT INDUCTOR

(71) Applicant: TOKO, INC., Tsurugashima-shi, Saitama-ken (JP)

(72) Inventor: Kazuhisa Kitamura, Tsurugashima (JP)

(73) Assignee: Murata Manufacturing Co., Ltd., Nagaokakyo-shi, Kyoto (JP)

( * ) Notice: Subject to any disclaimer, the term of this patent is extended or adjusted under 35 U.S.C. 154(b) by 11 days.

(21) Appl. No.: 14/946,146

(22) Filed: Nov. 19, 2015

(65) Prior Publication Data

US 2016/0148741 A1 May 26, 2016

(30) Foreign Application Priority Data

Nov. 21, 2014 (JP) ..... 2014-236242

(51) Int. Cl.
*H01F 27/29* (2006.01)
*H01F 27/02* (2006.01)

(52) U.S. Cl.
CPC ..... *H01F 27/292* (2013.01); *H01F 27/02* (2013.01)

(58) Field of Classification Search
CPC ..... H01F 27/292; H01F 17/043; H01F 2017/046; H01F 2027/2857
See application file for complete search history.

(56) References Cited

U.S. PATENT DOCUMENTS 1,165,779 A * 12/1915 Humphrey ..... B21F 3/02 244/45 R
2,080,024 A * 5/1937 Yoder ..... H01F 5/00 336/92
3,195,182 A * 7/1965 Sewell ..... H01P 11/00 425/391

(Continued)

FOREIGN PATENT DOCUMENTS

CN 101553891 A 10/2009
CN 103339695 A 10/2013

(Continued)

OTHER PUBLICATIONS

Chinese Office Action with English Translation (Application No. 2015108096331) (dated May 2, 2018—10 pages).

*Primary Examiner* — Elvin G Enad
*Assistant Examiner* — Malcolm Barnes
(74) *Attorney, Agent, or Firm* — Renner, Kenner, Greive, Bobak, Taylor & Weber

(57) ABSTRACT

A surface-mount inductor including a coil formed by winding a rectangular wire, and a mounting body for accommodating the coil, the coil having first rolls of the wire wound in a two-roll arrangement, second rolls being wound at positions shifted away from the first rolls along the winding axis, and lead ends brought out from the outermost turn of the second rolls; the mounting body containing a protruded portion for inserting into the winding axis of the coil, and a pair of bottomed magnetic cores having slits respectively, (Continued)

the protruded portion being inserted into the winding axis of the coil so that the mounting body is embedded in the coil with sealant to incorporate the magnetic cores with the coil and to expose the core mounting face of the magnetic cores therefrom, as well as a method for manufacturing the same.

16 Claims, 7 Drawing Sheets

(56) References Cited

U.S. PATENT DOCUMENTS 3,644,986 A * 2/1972 Verma ..... H01F 27/325
29/593
5,321,965 A * 6/1994 Baird ..... H01F 27/2823
72/142
2005/0212644 A1* 9/2005 Yoshimori ..... H01F 5/02
336/224
2006/0186975 A1* 8/2006 Wang ..... H01F 17/045
335/83
2010/0259353 A1* 10/2010 Saito ..... H01F 27/292
336/205
2013/0307655 A1* 11/2013 Saito ..... H01F 17/043
336/83
2014/0145667 A1* 5/2014 Damjanovic ..... H01F 27/327
336/222
2015/0325361 A1* 11/2015 Zajc ..... H01F 27/2847
336/173
2016/0086725 A1* 3/2016 Igarashi ..... H01F 27/292
336/83
2016/0307694 A1* 10/2016 Ohtsubo ..... H01F 27/292

FOREIGN PATENT DOCUMENTS

CN 103779041 A 5/2014
JP 2004193215 A * 7/2004 ..... H01F 1/26
JP 2011-243703 A 12/2011

* cited by examiner

SURFACE-MOUNT INDUCTOR

CROSS REFERENCE TO RELATED APPLICATIONS

This application is based upon and claims the benefit of priority from the prior Japanese Patent Application No. 2014-236242, filed on Nov. 21, 2014, the entire contents of which are incorporated herein by reference.

BACKGROUND OF THE INVENTION

1. Field of the Invention

The present invention relates to a surface-mount inductor including a coil formed by winding a wire and a body for accommodating and mounting the coil, and a method for manufacturing the same.

2. Related Applications

Among conventional surface-mount inductors, there is an inductor, as shown in FIG. 8, having a coil 41 which is configured by winding a wire of rectangular section in such a manner that its wide surface directs to the vertical direction to the winding axis of the coil, and the lead ends 41*d* are connected to the connecting portion 41*d* of the coil 41 to form a molded body 42, thus the metal frame 45 exposed from the molded body 42 is folded along the molded body 42 to make external terminals (JP2011-243703).

This type of inductor has an undesirable increase both in the number of parts and in manufacturing costs. Also, such a conventional surface-mount inductor is riddled with the risk of defects because, since coil ends have to be welded to metal pieces when connecting the coil to the metal frame, the contacting portions of coil ends and metal pieces to be connected thereto are exposed to thermal and mechanical stresses. In addition, since in a conventional surface-mount inductor the winding axis of a coil is set orthogonally to the circuit wiring board, its electric characteristics are directional and require some indication showing the polarity of the terminals.

SUMMARY OF THE INVENTION

The present invention aims to provide a surface-mount inductor which has a minimal occurrence of defects, a reduced requisite number of parts, is easy to manufacture and needs no indication of polarity, as well as a method for manufacturing the same.

The surface-mount inductors and the methods for manufacturing the same according to the present invention are provided as described below:

a surface-mount inductor including a coil formed by winding a rectangular wire around the winding axis, and a mounting body for accommodating the coil, comprising:

the coil including first rolls of the wire wound in a two-roll arrangement, both ends of the wire being positioned at the outermost turns, and second rolls, whose inner diameter is equal to or larger than the outer diameter of the first rolls, wound at positions spaced away from the first rolls along the winding axis, and lead ends brought out from the outermost turn of the second rolls; and the mounting body including a protruded portion for inserting into the winding axis of the coil and a core mounting face, wherein a pair of bottomed magnetic cores having slits for bringing out the lead ends therethrough is fitted to the coil in such a manner that the protruded portion is inserted into the winding axis of the coil so that the mounting body is formed to seal the coil with sealant to incorporate the magnetic cores with the coil and to expose the core mounting face of the magnetic cores therefrom;

wherein the coil is incorporated in the mounting body in such a manner that the winding axis of the coil is parallel with the body mounting face of the mounting body, the lead ends extend to the core mounting face and the surfaces adjacent to the core mounting face, and the lead ends extending to the surface adjacent to the core mounting face are sealed with the sealant.

A surface-mount inductor including a coil formed by winding a rectangular wire around the winding axis, and a mounting body which has a body mounting face for accommodating the coil, comprising:

the coil including first rolls of the wire wound in a two-roll arrangement, second rolls, whose inner diameter is equal to or larger than the outer diameter of the first rolls, wound at positions spaced away from the first rolls along the winding axis, and third rolls wound to have an inner diameter equal to or larger than the outer diameter of the second rolls, both ends of the wire being positioned at the outermost turns, and lead ends brought out from the outermost turn of the third rolls; and the mounting body including a protruded portion for inserting into the winding axis of the coil and a core mounting face, wherein a pair of bottomed magnetic cores having slits for bringing out the lead ends therethrough is combined with the coil in such a manner that the protruded portion is inserted into the winding axis of the coil so that the mounting body is formed to seal the coil with sealant to incorporate the magnetic cores into the coil and to expose the core mounting face of the magnetic cores therefrom;

wherein the coil is incorporated in the mounting body in such a manner that the winding axis of the coil is parallel with the body mounting face of the mounting body, and that the lead ends extend to the core mounting face and to the surfaces adjacent to the core mounting face, the lead ends extending to the surface adjacent to the core mounting face being sealed with the sealant.

A method for manufacturing a surface-mount inductor including a coil formed by winding a rectangular wire, and a mounting body for accommodating the coil, comprising the steps of:

forming a coil having first rolls, second rolls and lead ends, by contacting the median portion of the wire to the spindle of a winding machine, to wind the first rolls in a manner that both ends of the wire are positioned at the outermost turn, with the second rolls, whose inner diameter is equal to or larger than the outer diameter of the first rolls, wound at positions on opposite sides along the winding direction of the coil, and with the lead ends brought out from the outermost turn of the second rolls; and forming a mounting body by combining a coil and a pair of magnetic cores having a mounting face, the magnetic cores having a protruded portion for inserting into the winding axis of the coil and slits for bringing out the lead ends of the coil to the mounting face therethrough, and arranging the coil and the cores in a mold, and then filling the mold with sealant while exposing the core mounting face so as to make the mounting body;

thus, the coil is inserted in the mounting body in such a manner that the winding axis of the coil is parallel with the body mounting face, and that the lead ends extend to the core mounting face and the surface adjacent to the core mounting face, the lead ends of the coil extending to the surface adjacent to the core mounting face being embedded with the sealant.

A method for manufacturing a surface-mount inductor including a coil formed by winding a rectangular wire, and a mounting body for accommodating the coil, comprising the steps of:

forming a coil having first rolls, second rolls and lead ends, by contacting the median portion of the wire to the spindle of a winding machine, to wind first rolls in a manner that both ends of the wire are positioned at the outermost turn, that second rolls, whose inner diameter is equal to or larger than the outer diameter of the first rolls, are wound at the positions each on opposite sides along the winding direction of the coil, and that third rolls, whose inner diameter is equal to or larger than the outer diameter of the second rolls, are wound at the positions on opposite sides along the winding direction of the coil, and that the lead ends are brought out from the outermost turn of the third rolls; and forming a mounting body by combining a coil and a pair of magnetic cores having a mounting face, the magnetic cores having a protruded portion for inserting into the winding axis of the coil and slits for bringing out the lead ends of the coil to the mounting face therethrough, by arranging the coil and the cores in a mold, and then by filling the mold with sealant while exposing the core mounting face so as to make the mounting body;

thus, the coil is inserted in the mounting body in such a manner that the winding axis of the coil is parallel with the body mounting face, and that the lead ends extend to the core mounting face and the surface adjacent to the core mounting face, the lead ends of the coil extending to the surface adjacent to the core mounting face being embedded with the sealant.

Since the present invention is configured as described above, the causes of manufacturing defective products may be reduced and the requisite number of parts may be decreased so that processing and manufacturing of a surface-mount inductor are simplified and indication of polarity is not required.

DETAILED DESCRIPTION OF THE INVENTION

Since the embodiments according to the present invention are configured as described in Claims, and the lead ends of the coil are brought to the body mounting face so as to form the external terminals by the lead ends, a metal frame is not required anymore, and there are no mechanical and thermal stresses due to crimping or welding when connecting a coil and a metal frame together, thus there is no risk of the electrical resistance increasing due to the state of the connection between the coil and the metal frame, or of the connections with the metal frame and the connections between the metal frame and the coil.

Further, according to the embodiments of the present invention, the directionality of the inductor is avoided because the winding axis is parallel with the body-mounting face.

Furthermore, according to the embodiments of the present invention, the coil is so configured in a manner to have the first rolls and the second rolls of the wire having a rectangular cross section, as the first rolls are wound in a two-roll arrangement so that the wide surface of the wire is parallel with the winding axis and both ends of the wire are positioned at the outermost turn of the winding, and the second rolls, whose inner diameter is equal to or larger than the outer diameter of the first rolls, are wound at positions on opposite sides along the coil axis, shifted away from the first rolls. Thus, the stresses applied to the wire when winding a coil are effectively avoided.

The preferred embodiments according to the present invention will be described below, referring to FIGS. 1 through 7.

Figure 1:
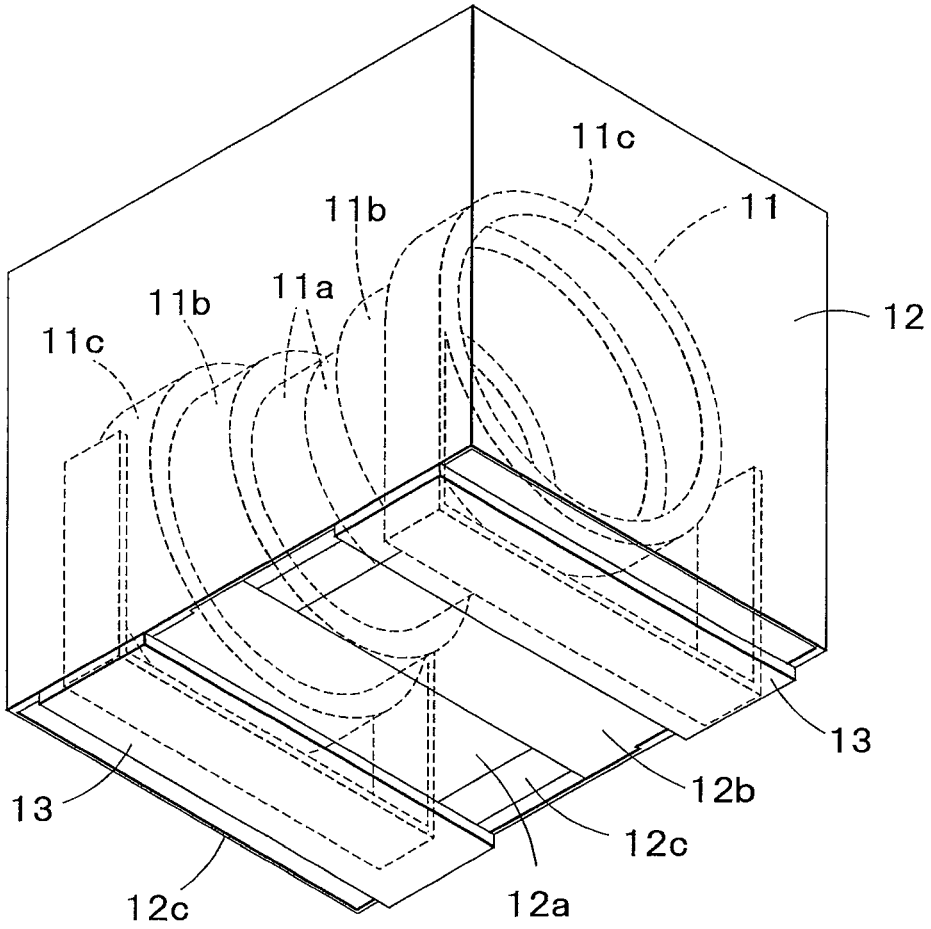
FIG. 1 is a perspective view of a surface-mount inductor as an embodiment according to the present invention.

FIG. 1 is a perspective view of the surface-mount inductor according to the present invention.

In FIG. 1, reference 11 denotes a coil, and reference 12 denotes a mounting body.

The coil 11 has first rolls and second rolls. The first rolls are wound in a two-roll arrangement so that the wide surface of the wire is parallel with the winding axis and both ends of the wire are positioned at the outermost turn of the winding. The second rolls, whose diameter of the innermost turn (inner diameter) is equal to or larger than the diameter of the outermost turn (outer diameter) of the first roll, are wound at positions on opposite sides of the first rolls along the coil axis. The wire used has a rectangular cross section and is covered with an insulation layer.

The mounting body 12 includes a protruded portion P (FIG. 4), and a pair of bottomed cores 12*a*, 12*b* which have slits S (FIG. 4) respectively for bringing lead ends of the coil 11 therethrough to the core mounting face. The pair of bottomed cores 12*a*, 12*b* is attached to the coil 11 and sealed with sealant, exposing the core mounting face outside.

The pair of bottomed cores 12*a*, 12*b* is made of ferrite. The coil 11 is incorporated in the mounting body 12 in such a manner that the winding axis is parallel with the mounting face of the mounting body 12, namely the body mounting face. The lead ends of the coil 11 extend to the core mounting face and to the surface adjacent to the core mounting face, and the extended portions of the lead ends are sealed with the sealant 12*c* to be fixed to the mounting body 12.

Also, the insulation layer on the extended portions of the lead ends of the coil 11 is removed to use the extended portions as external terminals. The external terminals 13 may be formed by shaping electrodes which cover the body mounting face of the lead ends of the coil 11, as shown in FIG. 1.

The surface-mount inductors are manufactured as described below. At first, a coil is formed by using a winding machine to wind a wire as both ends of the wire are positioned at the extremities of the outermost turn of the winding axis. The wire has a rectangular cross section and the surface is covered with an insulation layer.

Figure 2:
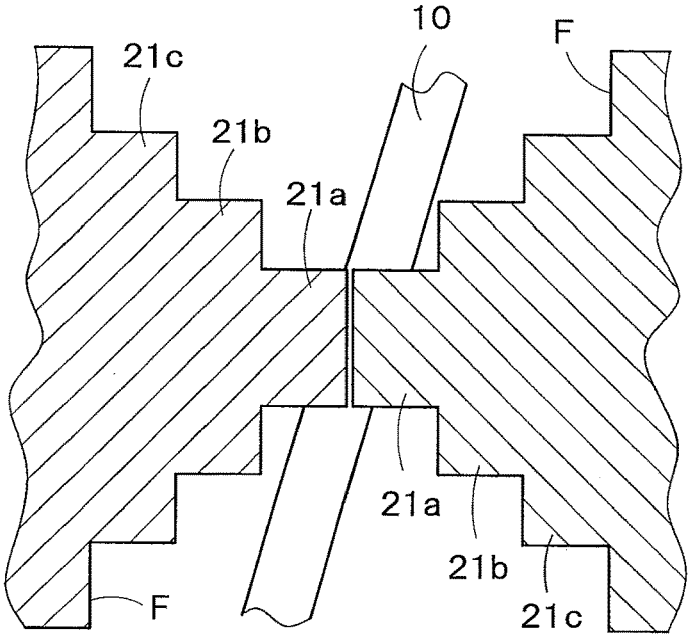
FIG. 2 is a sectional view showing the method for manufacturing the coil used in the inductor according to the present invention.

As shown in FIG. 2, the winding machine is provided with a pair of spindles, each of which has rolls of different diameters. The spindles of the winding machine are respectively provided with the first rolls 21*a* of cylindrical shape, the second rolls 21*b* of cylindrical shape adjacent to the first rolls, the second rolls having the same axis as that of the first rolls and an outer diameter equal to or larger than that of the first rolls 21*a*, third rolls 21*c* of cylindrical shape having an outer diameter equal to or larger than that of the second rolls 21*b*, and a flange F adjacently positioned to the third rolls 21*c*. Thus the first rolls 21*a* are positioned in such a manner that the ends of the spindle tips face and are contact with each other.

The first rolls 21*a*, the second rolls 21*b* and the third rolls 21*c* have the axial lengths similar to or larger than the width of the wire.

A wire is wound around the winding axis, directing the wide surface of the wire parallel with the direction of the outermost turn of the first rolls 21*a* and contacting the median portion of the wire thereto, and both ends of the wire are wound in different directions around the axis of the spindle. The coil of the first rolls 21*a* is wound in a two-roll arrangement and the diameter thereof is not larger than the outer diameter of the second rolls 21*b*. Thus, the windings of the first rolls 21*a* are formed.

Next, the ends of the wire are shifted away from the first rolls 21*a* in opposite directions along the winding axis, and the wire is wound with an outer diameter equal to or smaller than that of the third rolls 21*c* to form the windings of the second rolls 21*b*.

Subsequently, the ends of the wire are further shifted along the winding axis of the spindle to opposite sides, and the wire is wound to form the winding of the third rolls.

Further, the coil is heated and dismounted from the winding machine by distancing the pair of spindles from each other.

Figure 3:
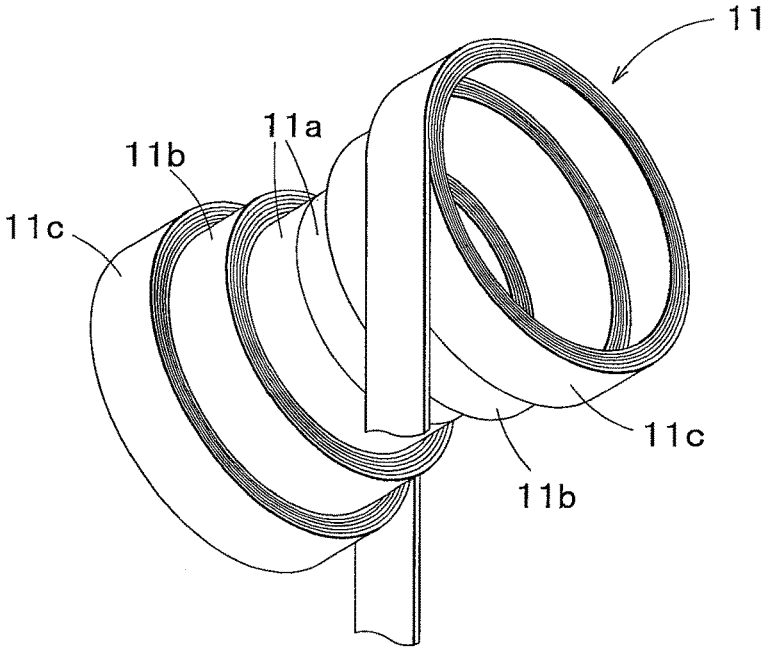
FIG. 3 is a perspective view of the coil used in the surface-mount inductor according to the present invention.

Thus, as shown in FIG. 3, the coil 11 is formed of wire which wide surface of the rectangular wire is in parallel with the winding axis so that the windings of the first rolls 11*a* are in a two-roll arrangement, in which the ends of the wire are positioned at the outermost turn, the windings of the second rolls 11*b* are wound around the winding axis in opposite directions along the winding axis of the coil, and the inner diameter of the second rolls 11*b* is equal to or larger than the outer diameter of the first rolls 11*a*, and the windings of the third rolls 11*c* are wound around the winding axis in opposite directions along the winding axis of the coil and the inner diameter of the third rolls 11*c* is equal to or larger than the outer diameter of the first rolls 11*b*.

Figure 4:
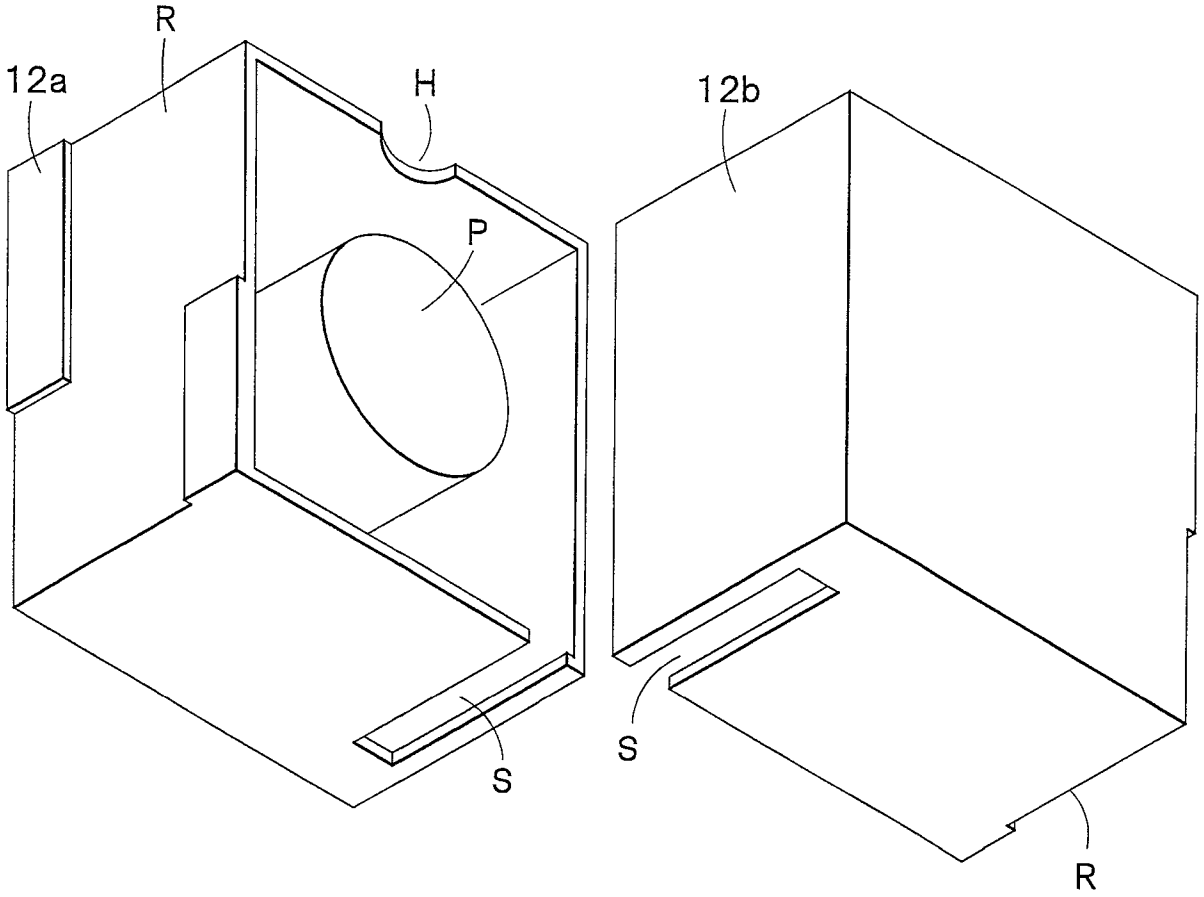
FIG. 4 is a perspective view of the magnetic cores used in the surface-mount inductor according to the present invention.

Then, as shown in FIG. 4, a pair of bottomed magnetic cores 12*a*, 12*b* is attached to the coil 11. The cores 12*a*, 12*b* have a protruded portion P for inserting into the winding axis of the coil 11, a slit S for bringing out the lead ends of the coil 11 to the mounting face, a hole H provided at the aperture side of the surface opposing the mounting face, and the recess R formed on the surface adjacent to the mounting face.

The pair of bottomed magnetic cores 12*a*, 12*b* is inserted, with the aid of the protruded portion P from both sides of the coil 11 along the axial direction, into the winding axis of the coil 11 to insert the lead ends into the slit S so as to be attached to the coil 11.

Figure 5:
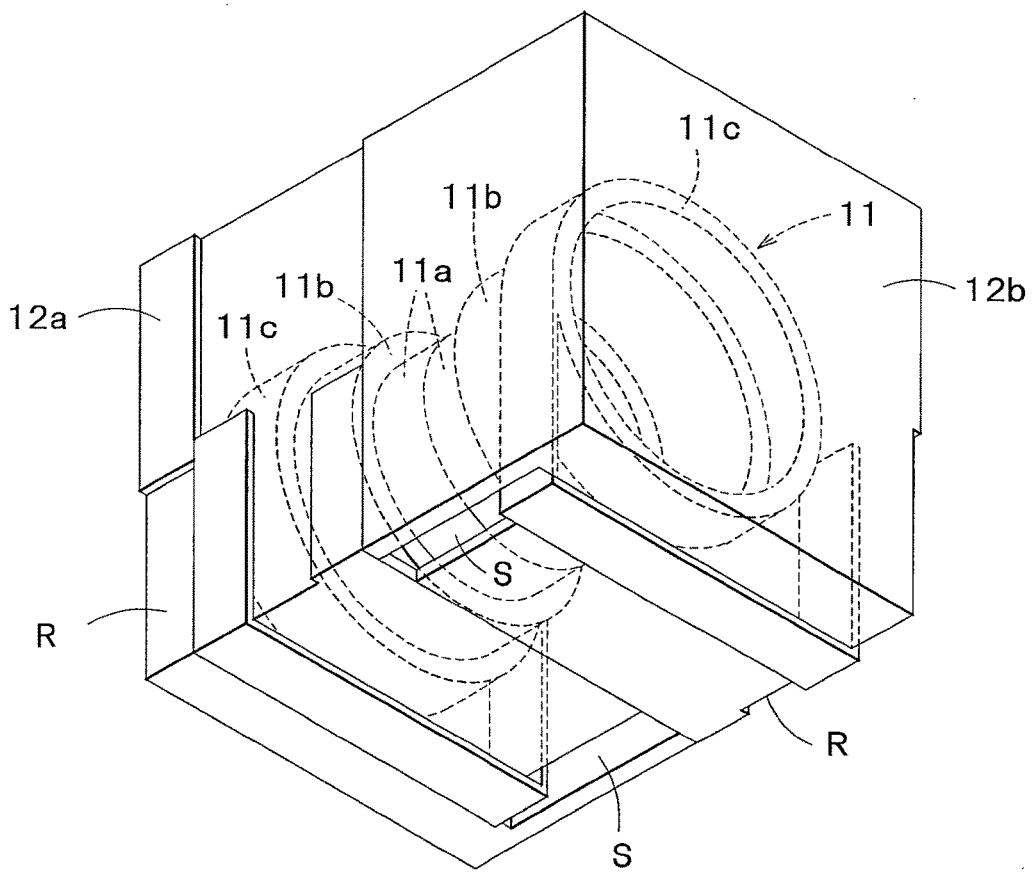
FIG. 5 is a perspective view of the surface-mount inductor, showing the method for manufacturing the inductor according to the present invention.

Further, as shown in FIG. 5, the lead ends brought out from the third rolls 11*c* of the coil 11 accommodated in the pair of bottomed magnetic cores 12*a*, 12*b* are folded along the magnetic cores 12*a*, 12*b* to extend over the mounting face of the magnetic cores 12*a*, 12*b* and over the surface adjacent to the mounting face.

Thus, as shown in FIG. 5, the portions of the lead ends brought out from the third rolls 11*c* of the coil 11, extending over the surface adjacent to the mounting face of the magnetic cores 12*a*, 12*b*, are placed in the recess R formed in the surface adjacent to the mounting face of the magnetic cores 12*a*, 12*b*.

Figure 6:
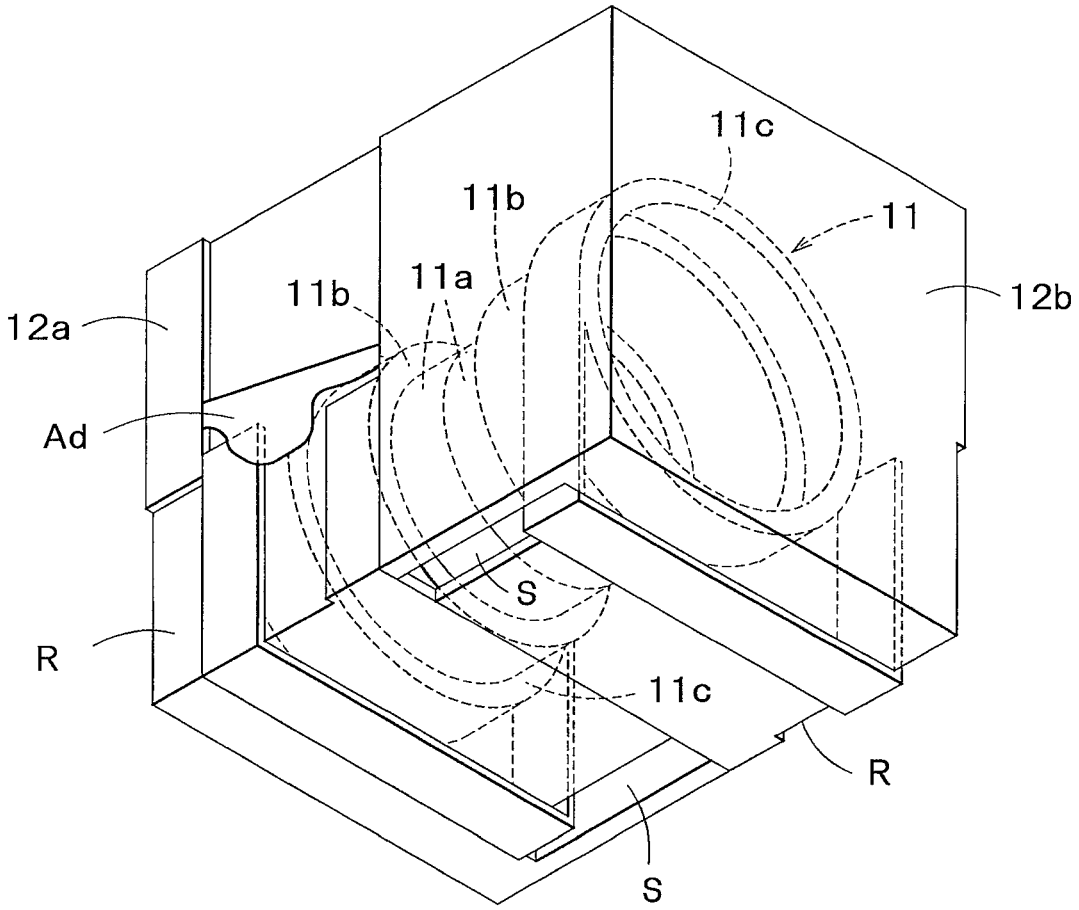
FIG. 6 is a perspective view of the surface-mount inductor, showing the method for manufacturing the inductor according to the present invention.

Subsequently, as shown in FIG. 6, the ends of the lead ends of the coil 11, which are placed in the recess R formed in the surface adjacent to the mounting face of the magnetic cores 12*a*, 12*b*, are fixed thereto by means of the Adhesive Ad.

Further, the magnetic cores 12*a*, 12*b* accommodating the coil 11 inside are placed in the mold (not shown) with the mounting face pointing upward, and sealant is injected inside the mold. The mold is filled with the sealant while exposing the mounting faces of the magnetic cores 12*a*, 12*b*. Since the magnetic cores 12*a*, 12*b* have the slits S and the hole H, the sealant may be injected up to the same level of the mounting face of the magnetic cores 12*a*, 12*b*.

Next, as shown in FIG. 1, the mounting body 12 is formed, solidifying the sealant and taking it out from the mold. The mounting body 12 incorporates the coil 11 in such a manner that the winding axis is parallel with the mounting face. Thus, the lead ends of the coil 11 extend over the core mounting face and the surface adjacent to the core mounting face. The mounting body 12 is entirely filled with the sealant, and the lead ends extending to the surface adjacent to the core mounting face are sealed.

Then, the insulation layer of the lead ends, extending over the body mounting face which is actually constituted of the core mounting face, is removed so that the lead ends are used as external terminals. The external terminals 13 may be provided with electrodes which cover the portion extending to the mounting face of the mounting body 12, namely the body mounting face.

Figure 7:
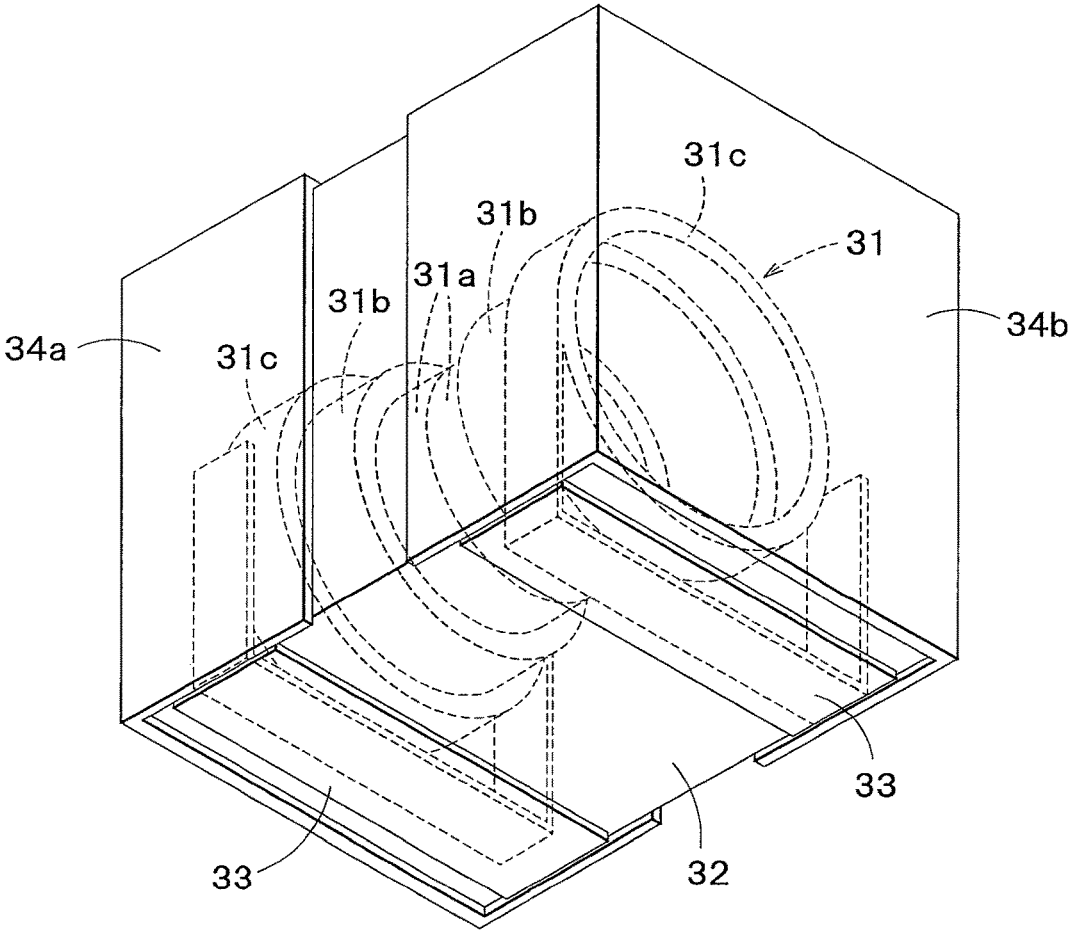
FIG. 7 is a perspective view of the surface-mount inductor, showing another method for manufacturing the inductor according to the present invention.
Figure 8:
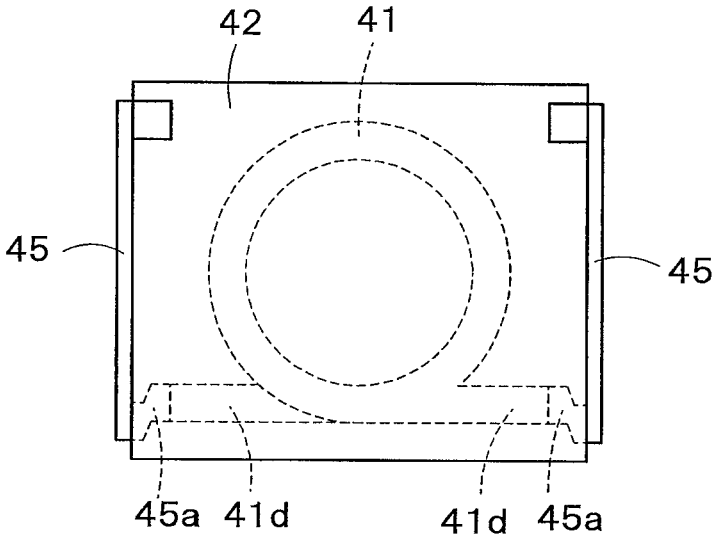
FIG. 8 is a perspective view of a conventional surface-mount inductor.

FIG. 7 is a perspective view of another surface-mount inductor according to the present invention.

The coil 31 has first rolls 31*a* which are wound in a two-roll arrangement as both ends of the rectangular wire are positioned at the outermost turn thereof, second rolls 31*b* which are shifted to opposite sides along the winding axis of the coil 31 and which inner diameter is equal to or larger than the outer diameter of the first rolls 31*a*, and third rolls 31*c* which are shifted to opposite sides along the winding axis of the coil and which inner diameter is equal to or larger than the outer diameter of the second rolls 31*b*, wherein lead ends are formed by bringing out the ends of the wire from the third rolls 31*c*.

The mounting body 32 includes a protruded portion to be inserted into the winding axis of the coil 31, and a pair of bottomed magnetic cores having slits for bringing out the lead ends of the coil therethrough. The mounting body is formed with the sealant exposing the surface of the lead ends of the coil, the lead ends extending to the core mounting face as described below.

The coil 31 is incorporated in the mounting body 32 in a manner that the winding axis is parallel with the mounting face of the mounting body 32. The lead ends of the coil 31 extend over the core mounting face and the surface adjacent to the core mounting face, the entire surface except the portion extending over the core mounting face being covered with the sealant to be fixed to the mounting body 32.

The lead ends, extending over the mounting face of the mounting body 32, are used as external terminals by removing the insulation layer. As shown in FIG. 1, electrodes for covering the portion which extends over the body mounting face may be employed as the external terminals.

The mounting body 32 is provided with a pair of metal bodies 34*a*, 34*b*. The pair of metal bodies 34*a*, 34*b* is formed to cover the upper surface, the end surface and the side surfaces adjacent to both of the upper and end surfaces, with the lower end thereof reaching the same level as the surface of the external terminals provided on the body mounting face. The pair of metal bodies 34*a*, 34*b* is attached to both of the end surfaces to make a vacant area between the metal bodies 34*a*, 34*b* and the surfaces of the external terminals 33. Since the metal bodies 34*a* and 34*b* are distanced so they do not contact each other.

The surface-mount inductor described above, manufactured in a similar way to the other embodiments, is provided with a pair of metal bodies 34*a*, 34*b* which cover the upper surface, the end surface and the side surfaces adjacent to the upper and end surfaces with vacant areas between the metal bodies 34*a*, 34*b* and the external terminals 33, 33.

When mounting and soldering the surface-mount inductor described above on a wiring board, the gaps between the metal bodies 34*a*, 34*b* and the external terminals 33 may be filled with solder fillet so as to firmly secure the surface-mount inductor to the board securely.

Although the surface-mount inductor and the method for manufacturing the same have been described in relation to the embodiments, the scope of the present invention should not be limited thereto, and the second rolls may be modified to be provided in plural pairs, or to be obliquely inclined along the winding axis.

In the embodiments, cylindrical spindles are employed therein. However, elliptical spindles or of other shape may be employed instead, depending on the inside structure of the coil.

Further, although the coil having the first, second and third rolls is described in the embodiments, the present invention is also applicable to a coil having first rolls in a two-roll arrangement in which a rectangular wire is wound with its ends positioned at the outermost turn, and second rolls wound and shifted oppositely from the first rolls along the winding axis, the inner diameter of which is equal to or larger than the outer diameter of the first rolls, wherein the lead ends are brought out from the outermost turn of the second rolls.

Furthermore, the core mounting face may be covered with sealant in a manner to expose the surface of the lead ends. Also, ferrite powder may be mixed with the sealant therein.

EXPLANATION OF CODES

11 coil
12 mounting body
12*a*, 12*b* magnetic core
21*a* first roll
21*b* second roll
21*c* third roll
F flange
S slit
R recess
P protruded portion
H hole
Ad adhesive

What is claimed is:

1. A surface-mount inductor including a coil formed by winding a rectangular wire around the winding axis, and a mounting body for accommodating the coil, comprising:

the coil including first rolls of the wire wound in a two-roll arrangement, both ends of the wire being positioned at the outermost turns, and second rolls, whose inner diameter is equal to or larger than the outer diameter of the first rolls, wound at positions spaced away from the first rolls along the winding axis, and lead ends brought out from the outermost turns of the second rolls; outermost turns of the first rolls being in contact with at least part of innermost turns of the second rolls, and the mounting body including a protruded portion for inserting into the winding axis of the coil and a core mounting face, wherein a pair of bottomed magnetic cores each having a recess on an exterior surface and each having slits for bringing out the lead ends therethrough is fitted to the coil in such a manner that the protruded portion is inserted into the winding axis of the coil so that the mounting body is formed to seal the coil with sealant to incorporate the magnetic cores with the coil and to expose the core mounting face of the magnetic cores therefrom, wherein an inside and an outside of the mounting body is sealed with sealant only;

wherein the coil is incorporated in the mounting body in such a manner that the winding axis of the coil is parallel with the body mounting face of the mounting body, a gap between the coil and the mounting body is filled with the sealant, the lead ends extend to the core mounting face and the surfaces adjacent to the core mounting face, and the lead ends extending to the surface adjacent to the core mounting face are sealed with the sealant while the lead ends are placed in the recesses on the exterior surface of the magnetic cores.

2. The surface-mount inductor claimed in claim 1, wherein the coil comprises plural pairs of the second rolls.

3. The surface-mount inductor claimed in claim 1, wherein the lead ends are brought out to the peripheral extending directions of the coil, extend in opposite directions in a plane parallel with the winding axis, with the tips of the lead ends being folded.

4. The surface-mount inductor claimed in claim 1, wherein the core mounting face is covered with the sealant so as to expose the surface of the lead ends of the coil.

5. The surface-mount inductor claimed in claim 1, wherein the lead ends of the coil extending over the core mounting face constitute external terminals.

6. The surface-mount inductor claimed in claim 1, wherein external terminals are provided by covering the lead ends, which extend over the core mounting face, with conductors.

7. The surface-mount inductor claimed in claim 1, wherein a pair of metal bodies which cover the upper, end and side surfaces of the mounting body and which lower ends reach the same level as the surface of the external terminals provided at the body mounting face.

8. A surface-mount inductor including a coil formed by winding a rectangular wire around the winding axis, and a mounting body which has a body mounting face for accommodating the coil, comprising:

the coil including first rolls of the wire wound in a two-roll arrangement, both ends of the wire being positioned at the outermost turn, second rolls, whose inner diameter is equal to or larger than the outer diameter of the first rolls, which are wound at positions shifted away from the first rolls along the winding axis, third rolls wound to have an inner diameter equal to or larger than the outer diameter of the second rolls, and lead ends brought out from the outermost turn of the third rolls; outermost turns of the first rolls being in contact with at least part of innermost turns of the second rolls, outermost turns of the second rolls being in contact with at least part of innermost turns of the third rolls, and the mounting body including a protruded portion for inserting into the winding axis of the coil and a core mounting face, wherein a pair of bottomed magnetic cores each having a recess on an exterior surface and each having slits for bringing out the lead ends therethrough is combined with the coil in such a manner that the protruded portion is inserted into the winding axis of the coil so that the mounting body is formed to seal the coil with sealant to incorporate the magnetic cores with the coil and to expose the core mounting face of the magnetic cores therefrom, wherein an inside and an outside of the mounting body is sealed with sealant only;

wherein the coil is incorporated in the mounting body in such a manner that the winding axis of the coil is parallel with the body mounting face of the mounting body, a gap between the coil and the mounting body is filled with the sealant, and that the lead ends extend to the core mounting face and to the surfaces adjacent to the core mounting face, the lead ends extending to the surface adjacent to the core mounting face being sealed with the sealant while the lead ends are placed in the recesses on the exterior surface of the magnetic cores.

9. The surface-mount inductor claimed in claim 8, wherein the second rolls of the coil are obliquely inclined along the winding axis of the coil.

10. The surface-mount inductor claimed in claim 8, wherein the lead ends are brought out to the peripheral extending directions of the outermost turn of the coil, extend in opposite directions in a plane parallel with the winding axis of the coil, with the tips of the lead ends being folded.

11. The surface-mount inductor claimed in claim 8, wherein the core mounting face is covered with the sealant so as to expose the surface of the lead ends of the coil.

12. The surface-mount inductor claimed in claim 8, wherein the lead ends of the coil extending over the core mounting face constitute external terminals.

13. The surface-mount inductor claimed in claim 8, wherein the external terminals are provided by covering the lead ends, which extend over the core mounting face, with conductors.

14. The surface-mount inductor claimed in claim 8, wherein a pair of metal bodies which cover the upper, side and end surfaces of the mounting body, and which lower ends of the metal bodies reach the same level as the surface of the external terminals which are provided at the body mounting face.

15. A method for manufacturing a surface-mount inductor including a coil formed by winding a rectangular wire, and a mounting body for accommodating the coil, comprising the steps of:

forming a coil having first rolls, second rolls and lead ends, by contacting the median portion of the wire to the spindle of a winding machine, to wind the first rolls in a manner that both ends of the wire are positioned at the outermost turn, that the second rolls, whose inner diameter is equal to or larger than the outer diameter of the first rolls, are wound at positions on opposite sides along the winding direction of the coil, and that the lead ends are brought out from the outermost turn of the second rolls; and forming a mounting body by combining a coil and a pair of magnetic cores each having a recess on an exterior surface and each having a mounting face, the magnetic cores having a protruded portion for inserting into the winding axis of the coil and slits for bringing out the lead ends of the coil to the mounting face therethrough, by arranging the coil and the cores in a mold, and then by filling the mold with sealant while exposing the core mounting face so as to seal an inside and an outside of the mounting body to make the mounting body;

thus, the coil is inserted in the mounting body in such a manner that the winding axis of the coil is parallel with the body mounting face, and that the lead ends extend to the core mounting face and the surface adjacent to the core mounting face, the lead ends of the coil extending to the surface adjacent to the core mounting face being embedded with the sealant with the lead ends being placed in the recesses on the exterior surface of the magnetic cores.

16. A method for manufacturing a surface-mount inductor including a coil formed by winding a rectangular wire, and a mounting body for accommodating the coil, comprising the steps of:

forming a coil having first rolls, second rolls and lead ends, by contacting the median portion of the wire to the spindle of a winding machine, to wind the first rolls in a manner that both ends of the wire are positioned at the outermost turn, the second rolls, whose inner diameter is equal to or larger than that of the second rolls, are wound at positions on opposite sides along the winding direction of the coil, that the third rolls, whose inner diameter is equal to or larger than the outer diameter of the second rolls, are wound at the positions each on opposite sides along the winding direction of the coil, and that the lead ends are brought out from the outermost turn of the third rolls; and forming a mounting body by fitting a coil and a pair of magnetic cores each having a recess on an exterior surface and each having a mounting face, the magnetic cores having a protruded portion for inserting into the winding axis of the coil and slits for bringing out the lead ends of the coil to the mounting face therethrough, by arranging the coil and the cores in a mold, and then filling the mold with sealant while exposing the core mounting face so as to seal an inside and an outside of the mounting body to make the mounting body;

thus, the coil is inserted in the mounting body in such a manner that the winding axis of the coil is parallel with the body mounting face, and that the lead ends extend to the core mounting face and the surface adjacent to the core mounting face, the lead ends of the coil extending to the surface adjacent to the core mounting face being embedded with the sealant with the lead ends being placed in the recesses on the exterior surface of the magnetic cores.

* * * * *